US005252793A

United States Patent [19]

Woods

[11] Patent Number: 5,252,793

[45] Date of Patent: Oct. 12, 1993

[54] MICROWAVE CONTAINER ASSEMBLY

[75] Inventor: Kenneth D. Woods, Keighley, England

[73] Assignee: Waddington Cartons Limited, Leeds, England

[21] Appl. No.: 842,126

[22] PCT Filed: Sep. 21, 1990

[86] PCT No.: PCT/GB90/01464

§ 371 Date: May 15, 1992

§ 102(e) Date: May 15, 1992

[87] PCT Pub. No.: WO91/05448

PCT Pub. Date: Apr. 18, 1991

[30] Foreign Application Priority Data

Sep. 27, 1989 [GB] United Kingdom ..... 8921754

[51] Int. Cl.[5] ..... H05B 6/80

[52] U.S. Cl. ..... 219/10.55 E; 219/10.55 F; 426/107; 426/234; 426/110; 99/DIG. 14; 229/903

[58] Field of Search ..... 219/10.55 E, 10.55 F; 426/107, 234, 241, 243, 109, 110; 99/DIG. 14; 229/903, DIG. 14

[56] References Cited

U.S. PATENT DOCUMENTS

| | | | |
|---|---|---|---|
| 4,228,945 | 10/1980 | Wysocki | 229/DIG. 14 |
| 4,355,757 | 10/1982 | Roccaforte | 229/DIG. 14 |
| 4,555,605 | 11/1985 | Brown et al. | 219/10.55 E |
| 4,592,914 | 6/1986 | Kuchenbecker | 426/107 |
| 4,661,672 | 4/1987 | Nakanaga | 219/10.55 E |
| 4,745,249 | 5/1988 | Daniels | 219/10.55 E |
| 4,813,594 | 3/1989 | Brown et al. | 426/113 |
| 4,826,072 | 5/1989 | Hart | 229/903 |
| 4,870,233 | 9/1989 | McDonald et al. | 219/10.55 E |
| 4,877,932 | 10/1989 | Bernstein et al. | 219/10.55 E |
| 4,891,482 | 1/1990 | Jaeger et al. | 219/10.55 E |
| 4,992,638 | 2/1991 | Hewitt et al. | 219/10.55 E |
| 4,994,638 | 2/1991 | Iorns et al. | 219/10.55 E |

FOREIGN PATENT DOCUMENTS

| | | |
|---|---|---|
| 200220 | 11/1986 | European Pat. Off. . |
| 2367003 | 5/1978 | France . |
| 2201070 | 8/1988 | United Kingdom . |

*Primary Examiner*—Philip H. Leung

*Attorney, Agent, or Firm*—Zarley, McKee, Thomte, Voorhees & Sease

[57] ABSTRACT

A microwaveable package containing foodstuff is for direct placement with or without opening same, in a microwave oven so that the foodstuff can be microwave cooked. The foodstuff rests on a sheet of microwave receptor material and the package is designed so that there is an air space between the receptor material and the oven support table to prevent the table from acting as a heat sink to drain away heat generated by the receptor material during cooking.

8 Claims, 5 Drawing Sheets

MICROWAVE CONTAINER ASSEMBLY

This invention relates to packaging containers for use in connection with the microwave heating of foodstuffs.

It is known to provide in a packaging container which is otherwise transparent to microwave energy, a microwave interactive or receptor, material which heats up when subjected to the microwave radiation. The heating up of the receptor material serves to heat adjacent foodstuff, for the crisping or browning of same, it being a disadvantage of conventional microwave heating that although the foodstuff will heat up quickly and effectively under the influence of microwaves, it is not possible to obtain a crisping or browning effect and that certain products such as pizzas and chipped potatoes simply become hot and soft, and rather unpalatable.

The said receptor materials however overcome this disadvantage, in that said materials quickly heat up under the influence of the microwaves to a high temperature and heat from the receptor materials is transferred by conduction to the foodstuff.

Examples of receptor materials and their methods of manufacture and use are disclosed in the following published patent specifications:

U.S. Pat. No. 4,555,605
U.S. Pat. No. 4,590,349
U.S. Pat. No. 4,592,914
U.S. Pat. No. 4,553,010
U.K. Patent No. 2,046,060B A specific known packaging container for use in connection with microwave heating of foodstuffs comprises a box constructed of cut and creased material, specifically cardboard, and inside the container and resting on a base thereof, is provided a sheet of receptor material. The foodstuff , chipped potatoes rest on the receptor material and for the cooking of the foodstuff, the lid or a panel in the lid is moved to an open position, and the container is simply placed in a microwave oven and the assembly subjected to microwave energy. Whilst such packaging is sufficiently satisfactory to be commercial, if the package rests on a part of the oven which acts as a heat sink and conducts away heat from the receptor material, the foodstuff takes longer to heat up than it should.

To some extent this effect can be reduced if an air space can be created between the receptor material and the microwave oven support surface (support table) on which the package stands.

Several attempts have been made to overcome this difficulty, and in one suggested arrangement, where a packaging container includes a receptor layer and a pizza resting thereon, the pizza and receptor material are removed, and the container is turned upside down and then the receptor material and pizza are placed on the underside of the base of the container. Another proposal provides that one portion of the container when the container is opened is folded back to form a support to keep the remainder of the container which supports the product on the receptor material clear of the microwave oven table.

These arrangements have a certain inconvenience because they require a degree of manipulation on the part of the user, and if the user forgets to perform such manipulation, then unsatisfactory cooking may result.

The present invention seeks to deal with this problem from a different approach, and in accordance with the invention, there is provided a packaging container of cut and creased material containing a foodstuff or for containing a foodstuff to be microwaved, wherein the container is constructed so as to provide a platform forming the base of the container on which the product rests and when placed in a microwave oven, said platform being spaced from a support surface or edge defined by the container so that the platform will be kept clear of the microwave table during microwaving of the product, which is achieved by simply placing the container and its contents, with the lid open or removed as required, directly into the microwave oven, said platform comprising or including a layer of microwave receptor material.

By the present invention, the container is constructed so that there is created within same a platform spaced from a support edge or surface so that the container and its contents can be simply placed directly in the microwave oven with the support surface or lodge resting on the microwave oven table. The user is therefore subjected to the minimum of inconvenience.

The container may have a lid or lid panel which has to be broken or torn open in order to expose the contents for cooking, but no further manipulation of the container is required.

The air space located under the platform will form an insulation space to prevent loss of heat from the receptor material. In one particular embodiment of the invention, the container has a base of the cut and creased material, and the receptor material is attached to or rests on the base, and around the base are sides or ledges which form legs to separate the base from the microwave oven table during the heating process.

In this construction, the receptor material preferably is deposited on a synthetic plastics film in the form of a strip, and the film is laminated to a cut and creased blank which forms the container so that the receptor material will cover the base. The base may be formed in a panel having a main section which forms said base, and edge sections around the sides of the main section, said edge sections lying to the inside of walls of the container and the edge sections being sealed to the walls by heat sealing of the synthetic plastics material film faces which come together by virtue of being on the faces of the edge sections and the insides of the container walls.

The legs therefore surrounding the base are of double thickness.

The container may have four sides, a top and the said base, and it may have an outwardly tapering configuration from top to base so that it has the form of a truncated pyramid. This facilitates the positioning of the base and its edge sections inside the lower edges of the walls, and also permits efficient nesting of the containers as the top will fit within the said legs when the containers are stacked one on top of another.

In an alternative arrangement according to the invention, the receptor material is anchored between a pair of side walls of the container so as to lie above a base panel of the container to provide said air space. The receptor material therefore forms a false base in the container on which the product rests. This can be achieved by utilising a panel of receptor material with respective side edge portions connected to the inner surfaces of side walls of the container.

Embodiments of these two aspects of the present invention will now be described, by way of example, with reference to the accompanying drawings, wherein.

Figure 1:
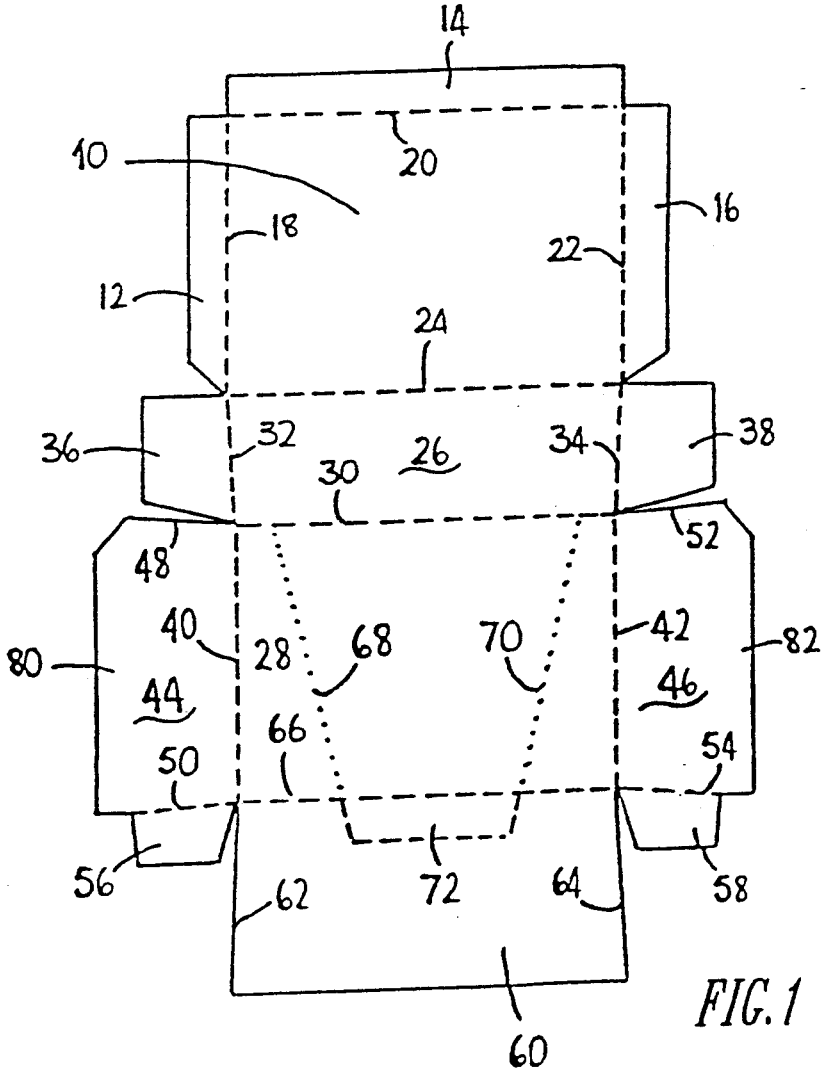
FIG. 1 is a plan view of a blank for constructing a container according to the invention.
Figure 6:
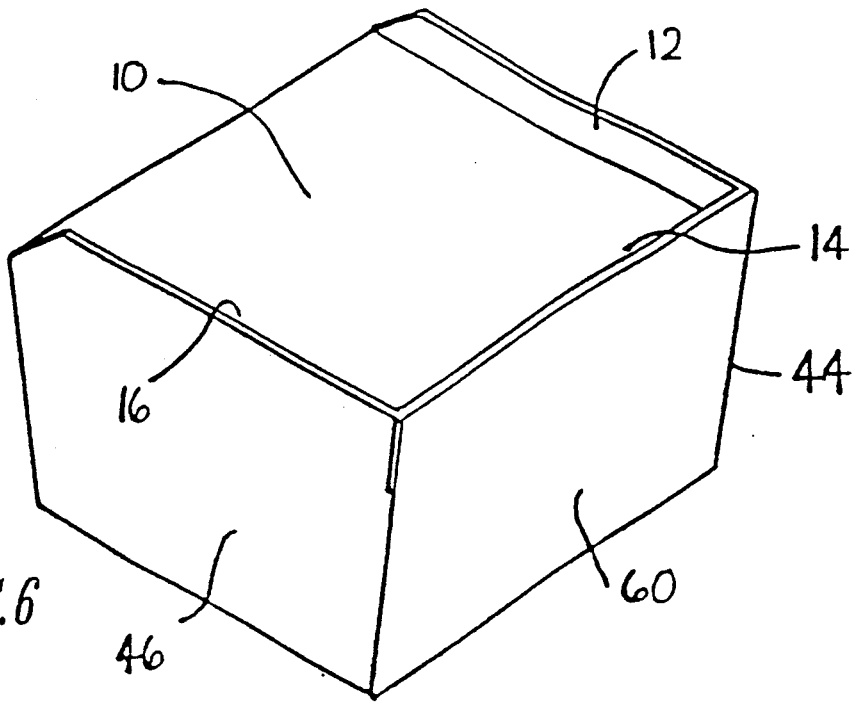
FIG. 6 is a view similar to FIG. 5 but showing the container in the sealed position.

Referring to the drawings, and firstly to FIG. 1, a container blank comprises a sheet of cut and creased material which can be folded and erected into the container shown in FIG. 6.

The blank comprises a base panel 10 of rectangular configuration with sealing strips 12, 14 and 16 hinged thereto along lines 18, 20 and 22. The fourth side of the rectangular base panel 10 is hinged along line 24 to a rear wall panel 26 which is generally rectangular and is hinged to a top panel 28 along a hinge line 30 at the opposite side of panel 26 from hinge line 24.

The ends of the panel 26 as defined by hinge lines 32 and 34 taper together in a direction from hinge line 24 to hinge line 30, and rear panel 26 has glue tabs 36 and 38.

The top panel 28 is also rectangular, but is slightly smaller than panel 10 so that the resulting container will have a truncated pyramid appearance, the purpose of which will be explained hereinafter.

Top panel 28 has hinged thereto along parallel hinge lines 40 and 42 container side panels 44 and 46 of which the sides 48, 50 and 52, 54 diverge in an outwards direction. Panels 44 and 46 have glue tabs 56 and 58 hinged thereto along hinge lines 50 and 54.

A front panel 60 with tapering sides 62, 64 is hinged to top panel 28 along hinge line 66.

Tear lines 68 and 70 in panel 28 and leading to tear tab 72 in the front panel 60 define a portion of the blank which can be torn away from the front and top panels 72 and 28 and be hinged along hinge line 30 to gain access to the interior of the container.

Figure 2:
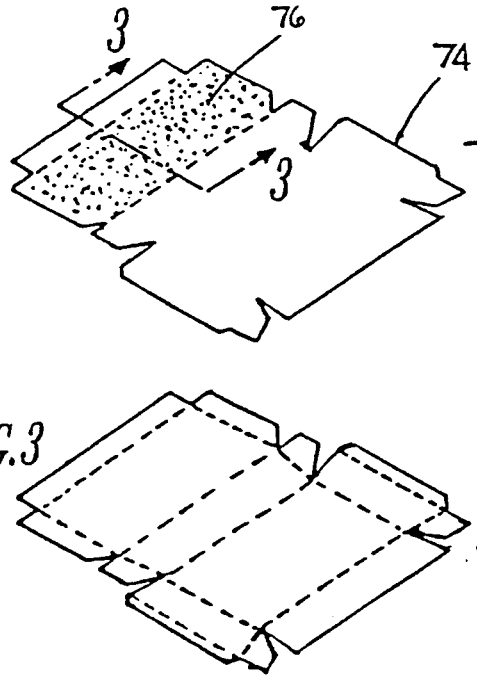
FIG. 2 shows how the blank of FIG. 1 is covered by means of a plastic film.
Figure 3:
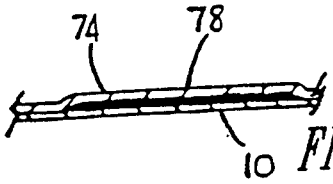
FIG. 3 is a sectional view of the blank taken on the line III—III in FIG. 2.

In this example of the invention there is laminated to the blank shown in FIG. 1 a plastic film 74 as shown in FIG. 2 which in this case is of polyester, and the film 74 is strip metalised with the receptor particles as indicated in the area 76 in FIG. 2 so as to form a receptor layer 78 sandwiched between the film 74 and the blank as shown in FIG. 3. The film 74 is in fact strip metalised so that the receptor layer will cover the base panel 10 as this is the surface on which the product to be microwave cooked will rest in the completed container.

Figure 4:
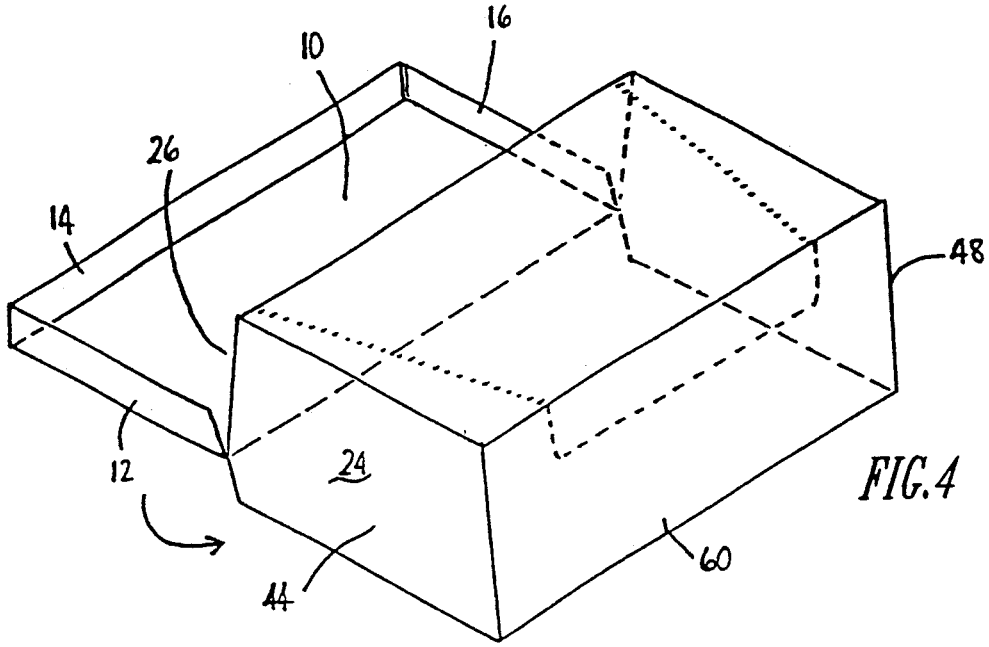
FIG. 4 shows the blank of FIG. 1 in an intermediate stage of erection.

If reference is made to FIG. 4, the erection of the blank of FIG. 1 to produce the container will be understood. It should be mentioned that the side of the blank which faces inwardly of the container is the side which is covered by the film 74.

To erect the container, the rear panel 26 is folded about fold line 30 and the glue tabs 36 and 38 are tucked inwardly. The sides 44 and 48 are turned downwardly and are glued to the tabs 36 and 38. It is to be noted at this time that the width of the sides 44 and 46 is greater than the width of the rear panel 26 so that edge portions 80 and 82 (FIG. 1) project beyond the horizontal plane containing fold line 24. These projections 80 and 82 serve for sealing to the sealing strips 12 and 16 as will be explained.

Next the glue tabs 56 and 58 are tucked inwardly, and finally the front panel 60 is folded downwardly and is glued to the tabs 56 and 58 and the position shown in FIG. 4 is reached. The width of the panel 60 is equal to the width of panels 44 and 46.

Figure 5:
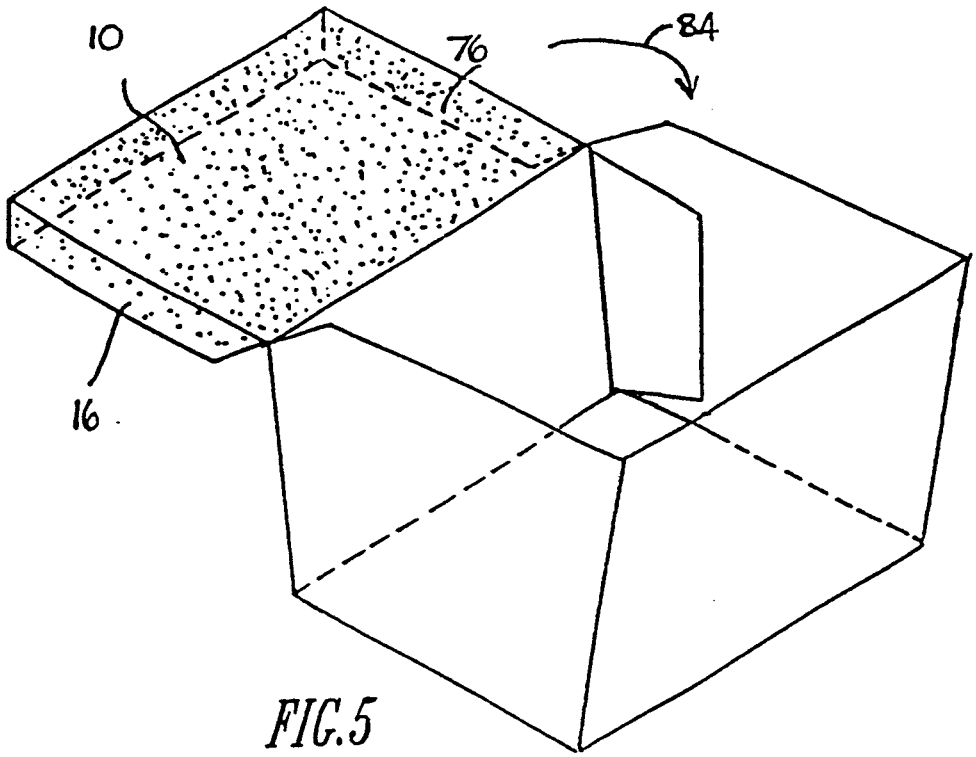
FIG. 5 shows the partially erected blank as illustrated in FIG. 4 but when viewed from the opposite side.

In FIG. 4 the base panel 10 is shown as having been hinged rearwardly about hinge line 24, and the container is shown in FIG. 5 in the inverted position in which the contents can be charged into the container through the open base side. The base panel 10 covered by the receptor material 76 can after filling of the container be folded inwardly as indicated by arrow 84 until the position shown in FIG. 6 is reached. It will be noticed that in -FIGS. 4 and 5 the sealing strips 12, 14 and 16 are folded out of the plane of the panel 10, and when the FIG. 6 position is reached the sealing strips 12, 14 and 16 lie with their free edges co-planar with the free edges of the side panels 44 and 46 and the front panel 60 so that in fact the base of the container is recessed for a purpose to be explained in relation to FIG. 7. The adjacent portions of the side panels 44 and 46 and the sealing strips 12, 14 and 16 can now be gripped in sealing jaws and pressed together and simultaneously heated in order to seal the sealing strips 12, 14 and 16 to the insides of the sides and front of the container improving the rigidity of the container, and sealing the contents therein.

The container thus filled with the product is now ready for sale.

Figure 7:
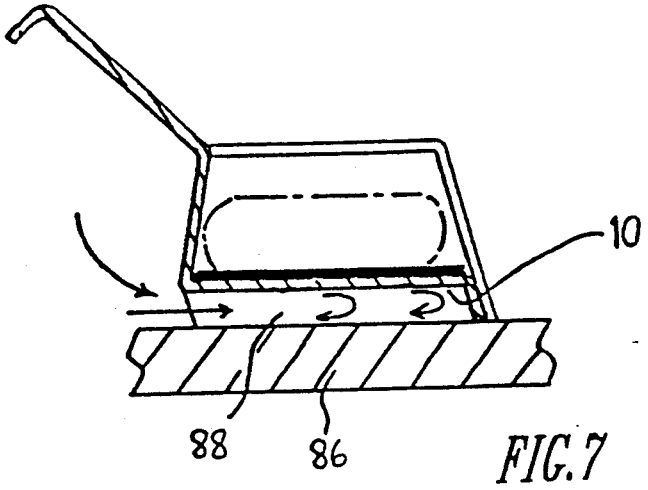
FIG. 7 is a sectional elevation of the container shown in FIG. 6 when in use in a microwave oven.

When it is to be used, the user opens the lid section as shown in FIG. 7, and simply places the container in a microwave oven on the microwave support surface 86 as shown in FIG. 7. It will be seen that the sealing strips and adjacent portions of the sides and front of the container form legs supporting the base panel 10 clear of the microwave support surface 86 and thereby creating an insulating air space 88 in which air can circulate as indicated by the arrows. This prevents a loss of heat from the receptor material as it heats up during the microwave cooking.

Because of the tapering of the sides of the front side and rear panels of the container, the container has a truncated pyramid appearance and by forming a recess in the base of the container, so similar containers can effectively be nested. Tapering also facilitates the movement of the base panel from the FIG. 5 position into the FIG. 6 position.

Instead of using a laminated receptor film to provide the receptor surface, a separate pad may be inserted in the container so as to rest on top of the base panel 10.

Figure 9:
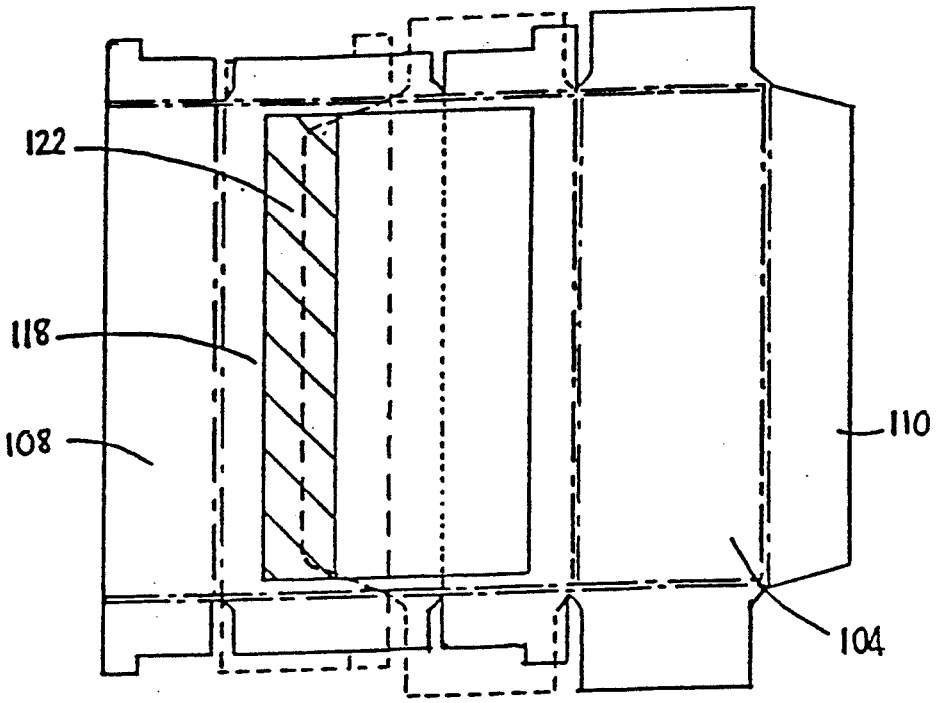
FIG. 9 is a view similar to FIG. 8 but showing the blank of FIG. 8 in a partially erected condition.
Figure 8:
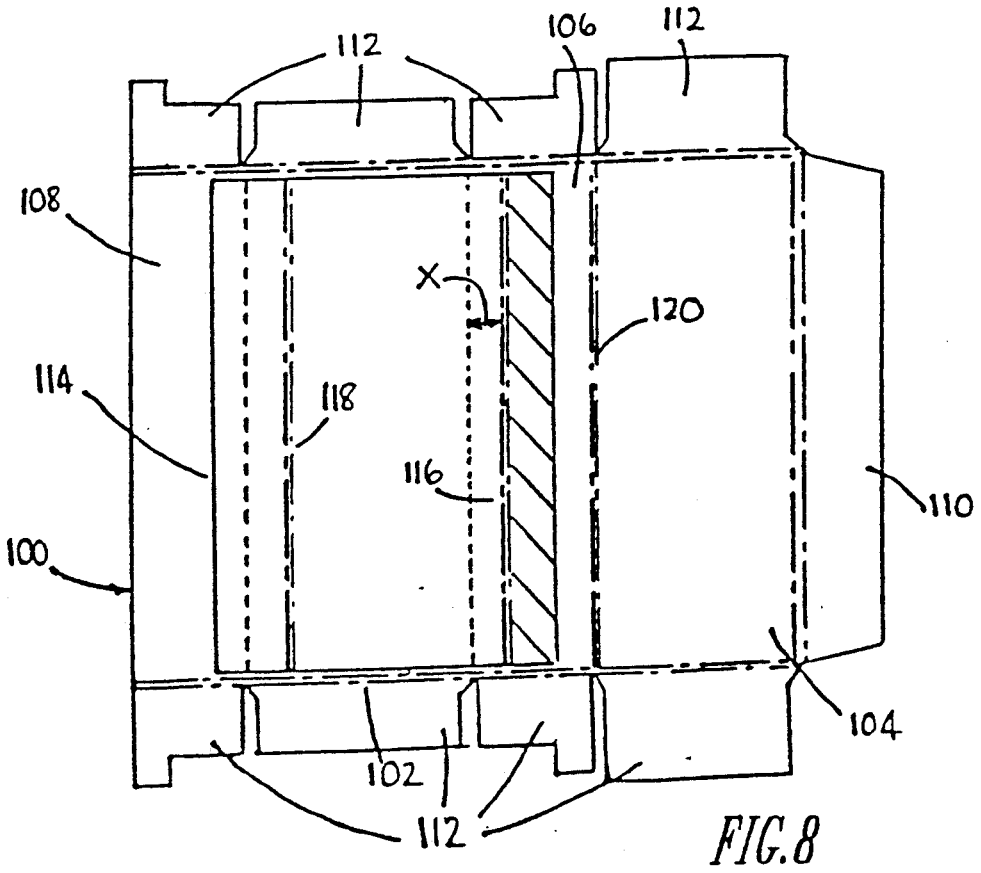
FIG. 8 is a plan view of a blank for producing a container according to a second embodiment of the invention.
Figure 10:
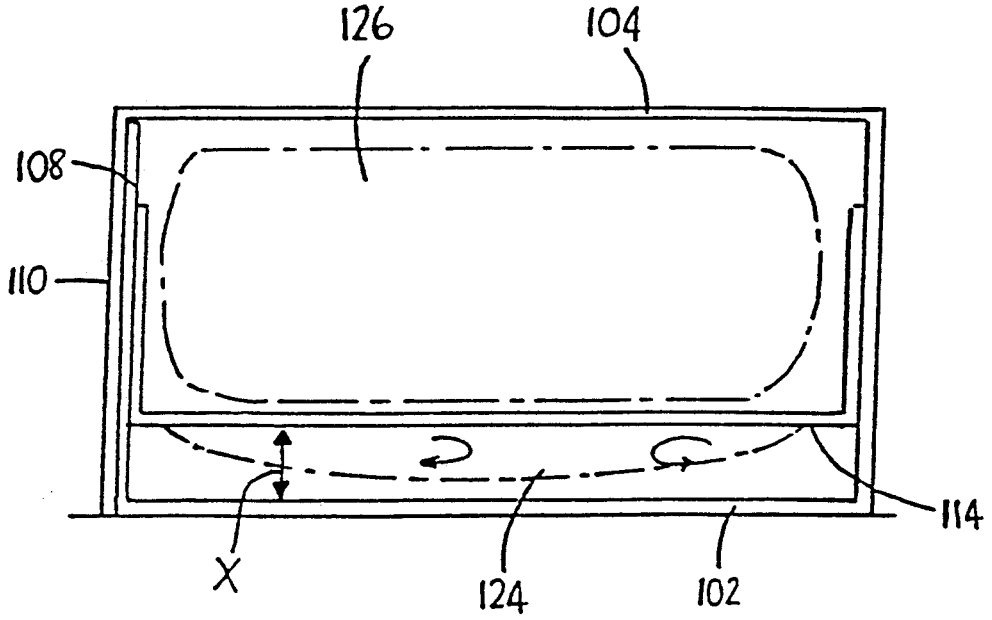
FIG. 10 is a sectional view of a container produced using the blank of FIGS. 8 and 9.

Referring now to the embodiment of the invention shown in FIGS. 8, 9 and 10, in FIG. 8 a conventional blank 100 comprises rectangular base and top panels 102, 104 hingedly interconnected by a side panel 106 and the second side panel 108 being hinged to base panel 102, and the top panel having a glue strip 110.

The various panels have end flaps 112 which in a conventional manner close the ends of the container when erected.

In this embodiment of the invention an overlay sheet 114 of receptor material is positioned so as to overlie the base panel 102 and parts of the side panels 106, 108. The receptor sheet has fold lines 116, 118 which are spaced by a distance equal to the width of the base panel 102, but the fold lines are offset by an amount X relative to the fold lines between the base panel 102 and the side panels 106, 108. This distance X being the distance by which it is required that the receptor material should be located above the base panel 102 in the erected carton in order to provide an air insulation space which performs a function similar to the air insulation space 88 in the FIGS. 1 to 7 embodiments.

The sheet 114 in connected to the side panel 106 in the shaded region 120 by gluing or the like, but is otherwise initially free from connection to the blank 100.

In order to erect the container from the blank shown in FIG. 8, the receptor material 114 is first of all folded about line 118 to the position shown in full lines in FIG. 9, and following this folding,, the side 108 is folded over as indicated in dotted lines in FIG. 9 so as to overlie the previously folded portion of the receptor sheet 114, and the receptor sheet is glued in the shaded area 122 as shown in FIG. 9 to the inside of the side panel 108. In order to complete the erection, the panel 104 is folded as shown in dotted lines in FIG. 9 to a -position in which the glue flap 110 overlies the previously folded side panel 108 and is glued thereto. The container is now in a flattened sleeve form and it is subsequently erected to three-dimensional form and the glue flaps 112 are tucked inwardly in order to, complete the closure.

If reference is made to FIG. 10, it will be seen that in the finished and erected container, the receptor material 114 is spaced from the base panel by the said distance X so that an insulating space 124 is formed between the receptor material and the surface on which the container will be supported when the package is placed in the microwave oven. The product is indicated generally by reference numeral 126, and it will be appreciated that with such a container when it is to be used, the user simply places the container inside the microwave oven. It may be that part of the container will have to be opened or it is recommended that it be opened for the microwave cooking in a manner similar to that illustrated in FIG. 7, and in this connection the container may be provided with suitable tear strips.

With the containers according to the invention, in that they are designed to have or provide an air space when the package is placed directly in a microwave oven, there is minimum inconvenience for the user and more consistent and better quality microwave cooking can be effected.

I claim:

1. A microwave foodstuff container of cut and creased sheet material comprising:

a casing have a top wall, side walls and a base panel formed from a single blank of said sheet material;

said top and side walls each having an upper edge, a lower edge, side edges, an inner side, and an outer side;

said base panel having a food support portion and a plurality of base panel edges, one of said base panel edges being hinged to said lower edge of one of said side walls, the other of said base panel edges each being formed into a flange section hinged to said food support portion;

each of said flange sections being operatively secured to one of said lower edges of one of said side walls in such a manner as to support said food support portion above said lower edges of said side walls; and receptor material carried by said base panel for heating foodstuffs carried by said food support portion in response to exposure to microwaves.

2. The microwave foodstuff container of claim 1 wherein said casing includes a lid or lid panel which has to be broken or torn open in order to expose the contents for cooking.

3. The microwave foodstuff container of claim 1 or 2 wherein said receptor material is deposited on a synthetic plastic film in the form of a strip and the film is laminated to the casing so that the receptor material will cover the base and the flange sections.

4. The microwave foodstuff container assembly as defined in claim 3 wherein the flange sections are sealed to the inner sides of the side walls by heat sealing of the synthetic plastics film on the flange sections which face the inner sides of the side walls of the casing.

5. The microwave foodstuff container as defined in claim 4 wherein the casing has four side walls which taper downwardly and outwardly from top to bottom so as to form a truncated pyramid.

6. A microwave foodstuff container of cut and creased sheet material comprising:

a casing have a top wall, side walls and a base panel formed from a single blank of said sheet material;

said top and side walls each having an upper edge, a lower edge, side edges, an inner side, and an outer side;

said base panel having a food support portion and at least one opposed pair of base panel edges each of which is formed into a flange section hinged to said food support portion;

each of said flange sections being operatively secured to one of said lower edges of one of said side walls in such a manner as to support said food support portion above said lower edges of said side walls; and receptor material carried by said base panel for heating foodstuffs carried by said food support portion in response to exposure to microwaves.

7. The microwave foodstuff packaging container as defined in claim 6 wherein the receptor material is formed into a receptor panel having receptor flange portions connected to the inner sides of at least some of said side walls of said casing.

8. The microwave foodstuff packaging container as defined in claims 6 or 7 wherein said casing has a lid or lid panel which has to be broken or torn apart in order to expose the contents for cooking.

* * * * *